US007171938B2

(12) United States Patent
Muramatsu

(10) Patent No.: US 7,171,938 B2
(45) Date of Patent: Feb. 6, 2007

(54) DRY SUMP TYPE LUBRICATION DEVICE FOR A MOTORCYCLE

(75) Inventor: Takayoshi Muramatsu, Shizuoka (JP)

(73) Assignee: Yamaha Hatsudoki Kabushiki Kaisha, Shizuoka-Ken (JP)

( * ) Notice: Subject to any disclaimer, the term of this patent is extended or adjusted under 35 U.S.C. 154(b) by 133 days.

(21) Appl. No.: 11/087,159

(22) Filed: Mar. 22, 2005

(65) Prior Publication Data

US 2005/0217631 A1 Oct. 6, 2005

(30) Foreign Application Priority Data

Mar. 30, 2004 (JP) ..... 2004-098071

(51) Int. Cl.
*B62J 31/00* (2006.01)

(52) U.S. Cl. ..... 123/196 R

(58) Field of Classification Search ..... 123/196 R, 123/196 S, 196 M

See application file for complete search history.

(56) References Cited

U.S. PATENT DOCUMENTS 6,047,667 A * 4/2000 Leppanen et al. ..... 123/196 R
6,305,342 B1 * 10/2001 Narita et al. ..... 123/196 R
6,314,934 B1 * 11/2001 Ito et al. ..... 123/196 R
6,318,333 B1 * 11/2001 Narita et al. ..... 123/196 R
6,332,444 B1 * 12/2001 Narita et al. ..... 123/196 R
6,823,829 B1 * 11/2004 Kawamoto et al. ..... 123/196 R
7,013,860 B2 * 3/2006 Takeuchi ..... 123/196 R
7,040,454 B2 * 5/2006 Kawamoto et al. ..... 184/106
2004/0244761 A1 * 12/2004 Takeuchi ..... 123/196 R

FOREIGN PATENT DOCUMENTS

JP 05-338573 12/1993

* cited by examiner

*Primary Examiner*—Stephen K. Cronin
*Assistant Examiner*—Jason Benton
(74) *Attorney, Agent, or Firm*—Hogan & Hartson LLP

(57) ABSTRACT

A dry sump type lubrication device for a motorcycle includes a four stroke engine having, in a crankcase bottom, a first oil pump for collecting lubricating oil and a second oil pump for delivering lubricating oil. A frame supporting the four-stroke engine and having left and right down tubes running around the crankcase from the crankcase front thereof toward a region therebelow is provided. An oil tank is disposed in a region surrounded by a forward end of the crankcase and the left and right down tubes, a return passage for the lubricating oil collected by the first oil pump to be returned to the oil tank. A feed passage for the lubricating oil returned to the oil tank to be introduced into the second oil pump and an overflow passage for the lubricating oil in the oil tank to be returned to the four-stroke engine are also provided.

20 Claims, 8 Drawing Sheets

DRY SUMP TYPE LUBRICATION DEVICE FOR A MOTORCYCLE

BACKGROUND OF THE INVENTION

1. Field of the Invention

This invention relates to a dry sump type lubrication device for a motorcycle with an oil tank disposed in front of a crankcase.

2. Description of Related Art

Recent years, motorcycles for motocross races have made progress in the changeover of their engines to four-stroke systems. Since the motorcycle of this type runs on rough ground of great irregularities, it is necessary to raise the mounting position of the engine to secure a sufficient minimum road clearance. Therefore, a dry sump type four-stroke engine is preferably used without an effective oil reservoir in the bottom of the crank chamber.

The dry sump type four-stroke engine is provided with an oil tank independent from the crankcase, and lubricating oil is forcedly circulated between the oil tank and the crankcase. Specifically, lubricating oil returned to the crankcase after lubrication of engine parts is sent into the oil tank through a first oil pump, and lubricating oil introduced from the oil tank to the crankcase is fed to the engine parts through a second oil pump. The first and second oil pumps are assembled in the bottom of the crankcase and connected to the oil tank through a connecting device such as pipes or hoses, respectively.

However, the oil tank has some volume and it is desirable that the oil tank is disposed as low as possible taking into account of lowering the center of gravity of the motorcycle. As a system to meet this requirement, a motorcycle has been known in which an oil tank is disposed right in front of the crankcase. This motorcycle is provided with a cradle type frame having left and right down tubes running around the crankcase from the front thereof toward a region therebelow, and an oil tank is disposed in a region surrounded by these down tubes and the forward end of the crankcase.

The conventional oil tank discussed above secures its volume by elongating its lower end such that it extends into a region below the crankcase. However, in this arrangement, since the oil tank protrudes downwardly from the crankcase, the minimum road clearance is lowered by as much size as the oil tank.

As a result, in a motorcycle for motocross races in particular, the oil tank might strike against the road surface during running. Therefore, in a motorcycle of an off-road model intended to run on rough ground, it is necessary to form the oil tank as compact as possible to decrease it downward protrusion from the crankcase.

However, an oil tank with the size reduced results in a decreased tank volume and a new problem arises as described below.

In a typical dry sump type four-stroke engine, the first oil pump for collecting lubricating oil returned to the crankcase has a larger volume than the second oil pump for feeding lubricating oil. Therefore, in a condition in which engine speed is low during an idling operation, for example, lubricating oil returning to the oil tank and lubricating oil drawn from the oil tank become ill-balanced and the inside of the oil tank is filled completely with lubricating oil.

In other words, if the amount of lubricating oil returning to the oil tank becomes larger than the amount of lubricating oil drawn from the oil tank, the change in oil quantity cannot be absorbed within the oil tank. Therefore, the inside pressure of the oil tank rises excessively, which may cause damage of the oil tank or leakage of lubricating oil from the connecting portions between the oil tank and connecting device.

An advantage of this invention is to provide a dry sump type lubrication device for a motorcycle capable of preventing excessive rise of the inside tank pressure while effecting size reduction of the oil tank.

SUMMARY OF THE INVENTION

In order to achieve the foregoing advantage, the dry sump type lubrication device for a motorcycle according to an embodiment of the present invention is provided with a four stroke engine having, in the bottom of a crankcase, a first oil pump for collecting lubricating oil and a second oil pump for delivering lubricating oil. A frame supporting the four-stroke engine and having left and right down tubes running around the crankcase from front thereof toward a region therebelow is provided. An oil tank is disposed in a region surrounded by the forward end of the crankcase and the left and right down tubes and a return passage for the lubricating oil collected by the first oil pump to be returned to the oil tank. A feed passage for the lubricating oil returned to the oil tank to be introduced into the second oil pump and an overflow passage for the lubricating oil in the oil tank to be returned to the four-stroke engine are also provided.

According to the present invention, if the amount of lubricating oil returning to the oil tank is too large and the oil tank is filled with the lubricating oil, an excess of the lubricating oil is sent automatically to the four-stroke engine through an overflow passage. Therefore, even if the tank volume is decreased in association with size reduction of the oil tank, excessive rise of the inside tank pressure can be avoided. As a result, damage of the oil tank is prevented, as well as leakage of lubricating oil from the connecting portions between the oil tank and passages.

DETAILED DESCRIPTION OF THE INVENTION

Now, an embodiment of this invention will be described with reference to the drawings.

Figure 1:
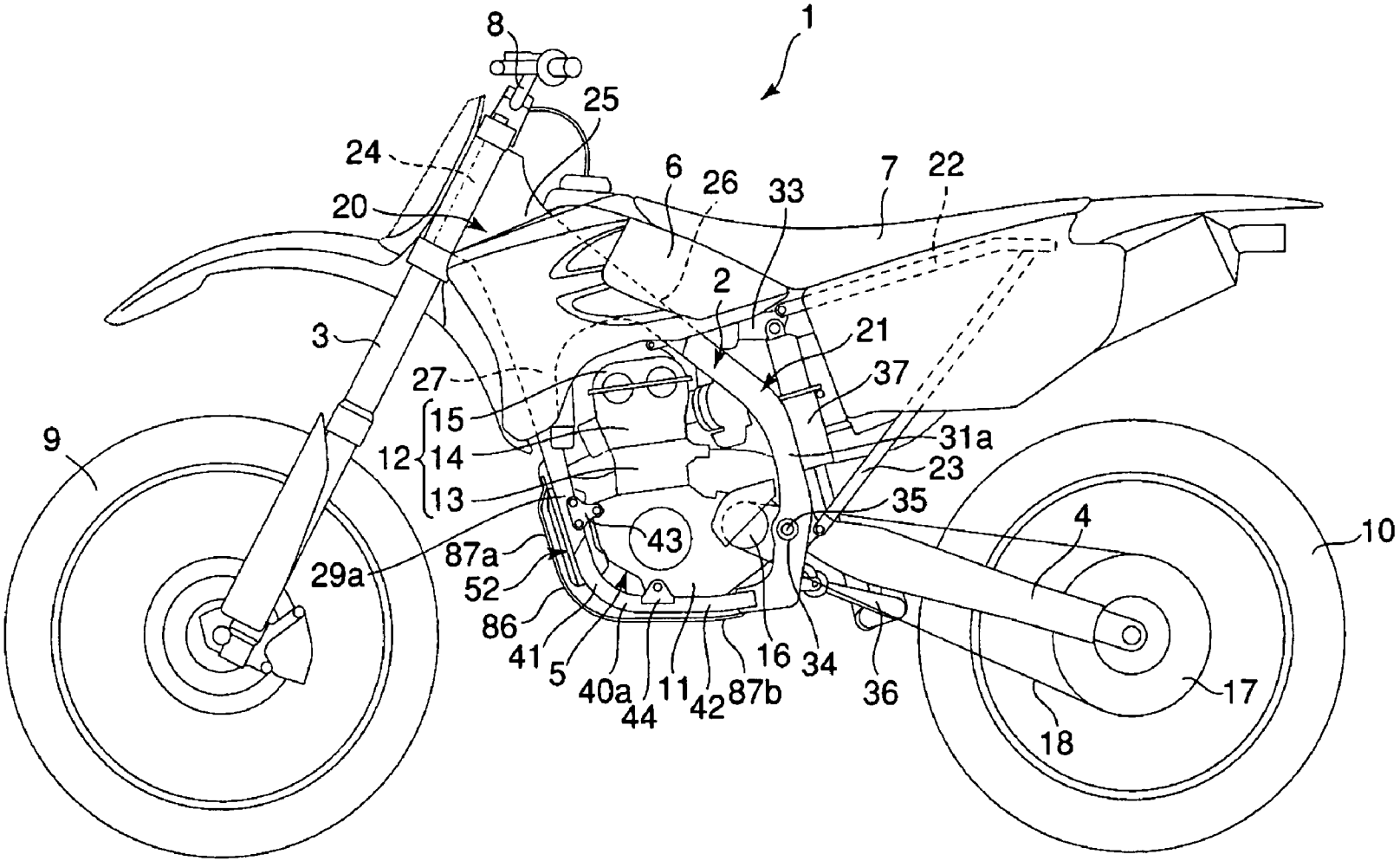
FIG. 1 is a side view of a motorcycle according to an embodiment of the present invention.

FIG. 1 shows a motorcycle 1, for example, for motocross races. The motorcycle 1 is provided with a frame 2 of a cradle type. The frame 2 supports a front fork 3; a rear arm 4; a water-cooled, four-stroke, single-cylinder engine 5; a fuel tank 6 and a seat 7.

The front fork 3 is controlled by a bar handle 8 for steering and supports a front wheel 9. The rear arm 4 extends rearwardly from the frame 2 and supports, at its rear end, a rear wheel 10.

The engine 5 is provided with a crankcase 11, and a cylinder section 12 standing approximately upright from the crankcase 11. The cylinder section 12 includes a cylinder block 13 connected to the upper surface of the crankcase 11, a cylinder head 14 mounted on the cylinder block 13 at the upper end, and a head cover 15 for covering the upper end of the cylinder head 14. The head cover 15 is formed with a valve drive chamber between the head cover 15 and the cylinder head 14. The valve drive chamber houses a valve drive mechanisms such as an intake cam shaft and an exhaust cam shaft.

The engine 5 is used for driving the rear wheel 10 and has a drive sprocket 16 at the rear end of the crankcase 11. A chain 18 is stretched between the drive sprocket 16 and a driven sprocket 17 of the rear wheel 10.

The fuel tank 6 is located directly above the engine 5. The seat 7 extends approximately horizontally from the upper surface of the fuel tank 6 toward the rear of the fuel tank 6.

Figure 2:
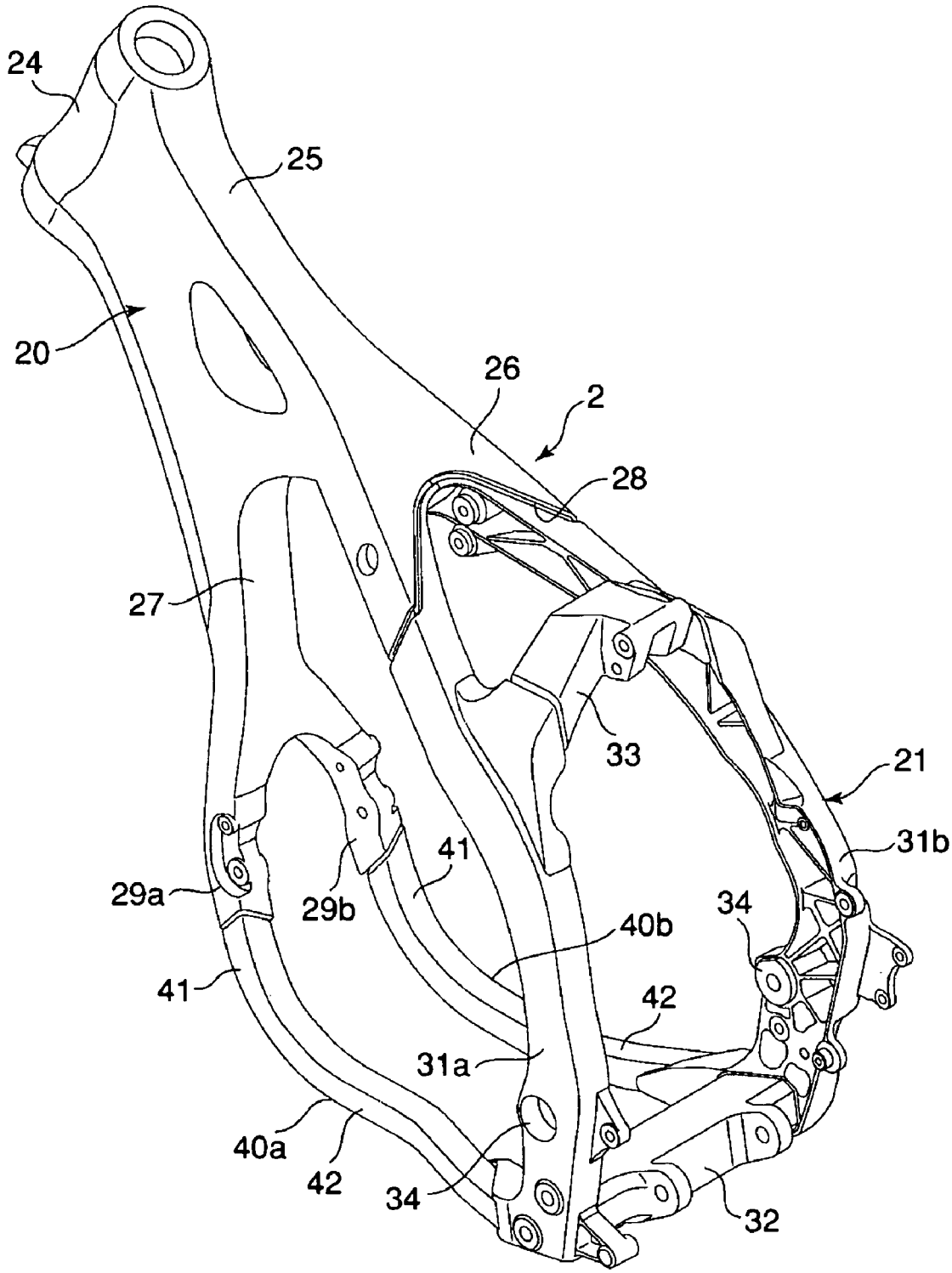
FIG. 2 is a perspective view of a cradle type frame used in the embodiment of the present invention.
Figure 3:
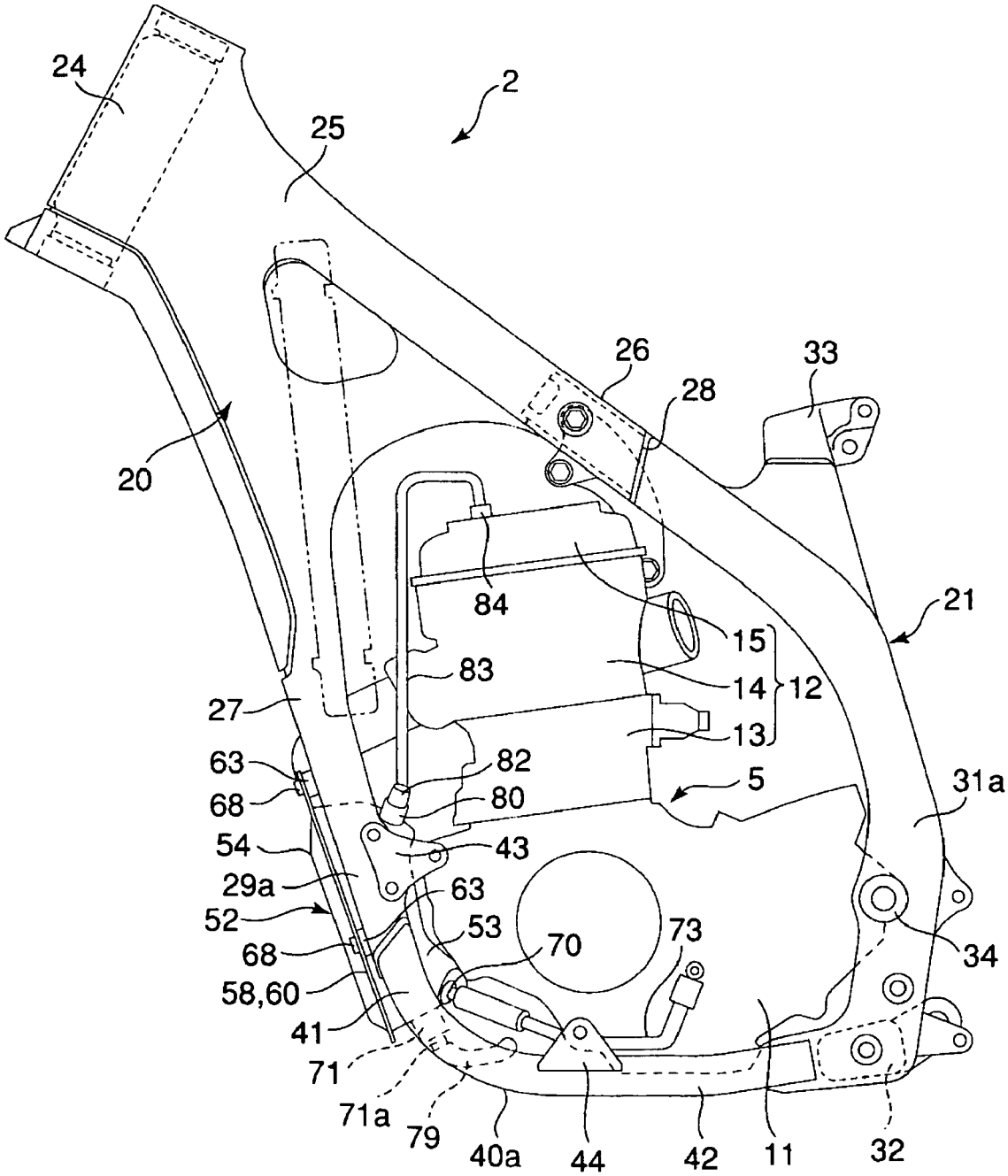
FIG. 3 is a side view showing the positional relationship between a dry sump type, four-stroke engine supported by the frame and an oil tank in the embodiment of the present invention.
Figure 4:
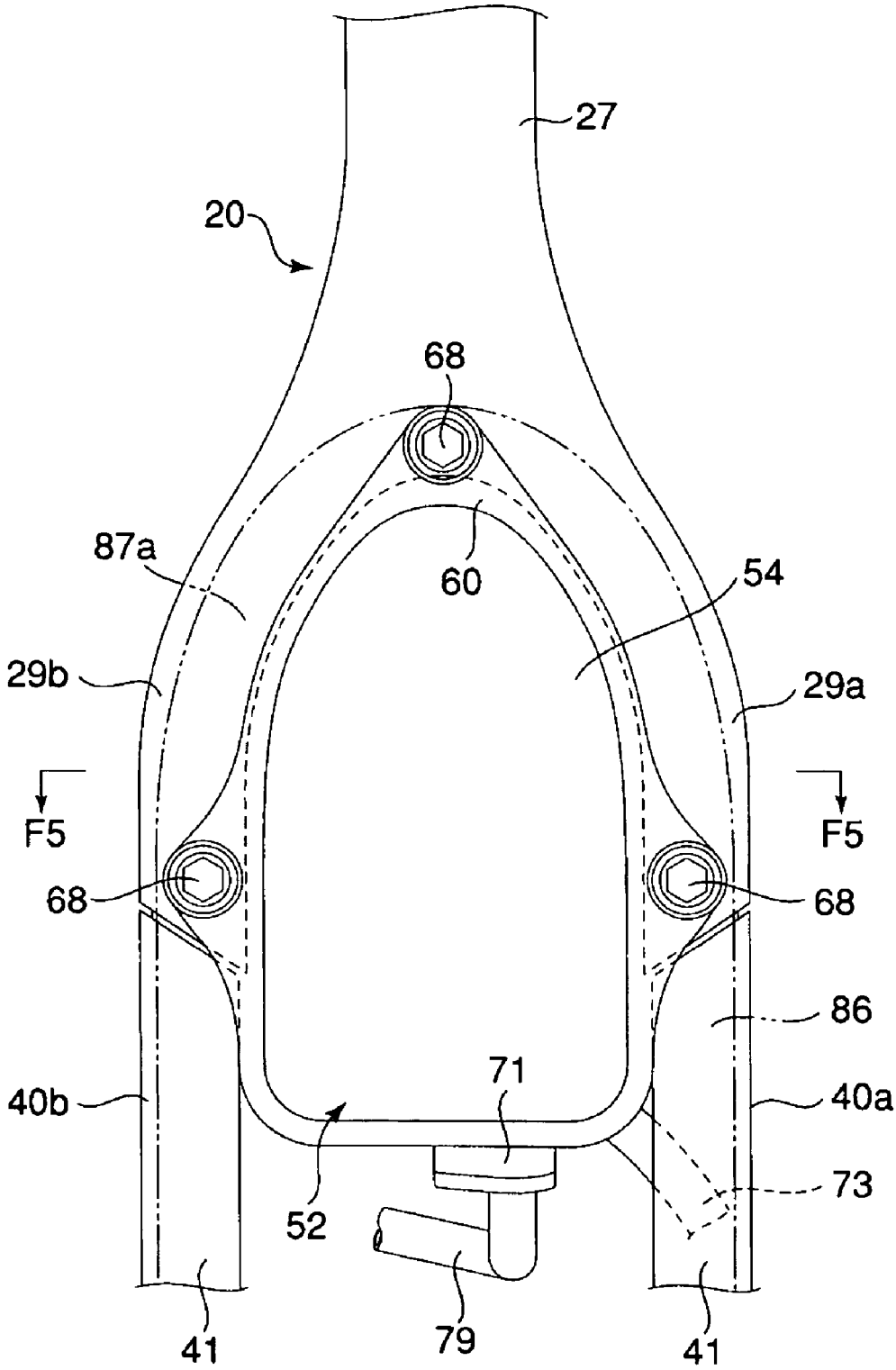
FIG. 4 is a front view showing the positional relationship between the frame and the oil tank in the embodiment of the present invention.
Figure 5:
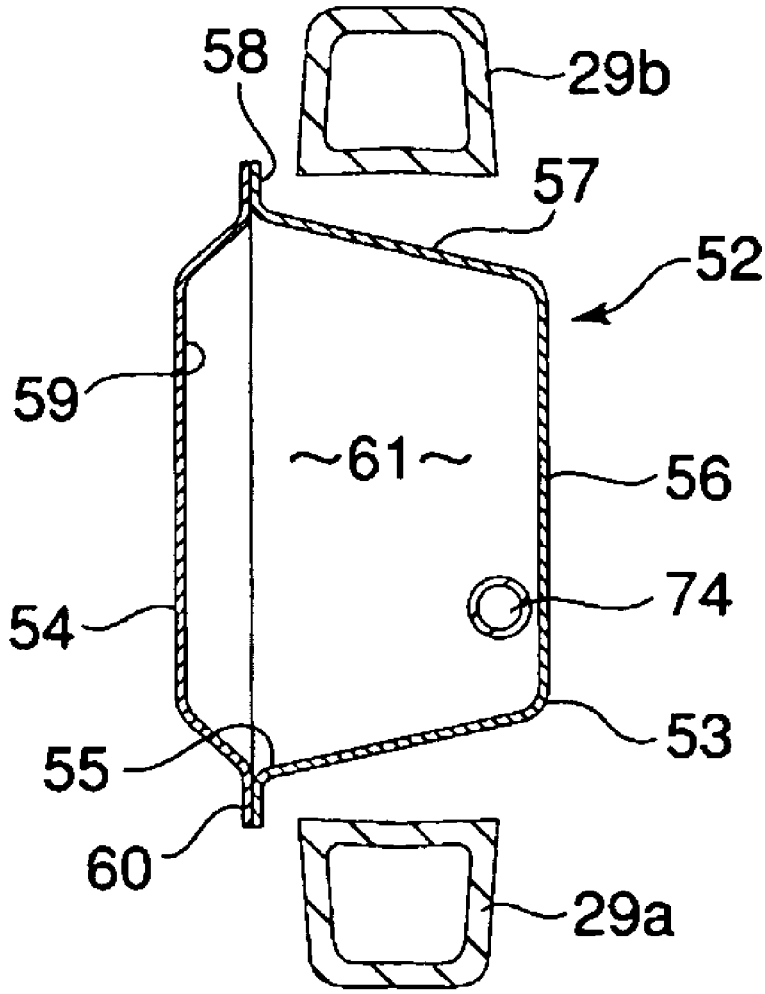
FIG. 5 is a sectional view taken along line F5—F5 of FIG. 4.
Figure 6:
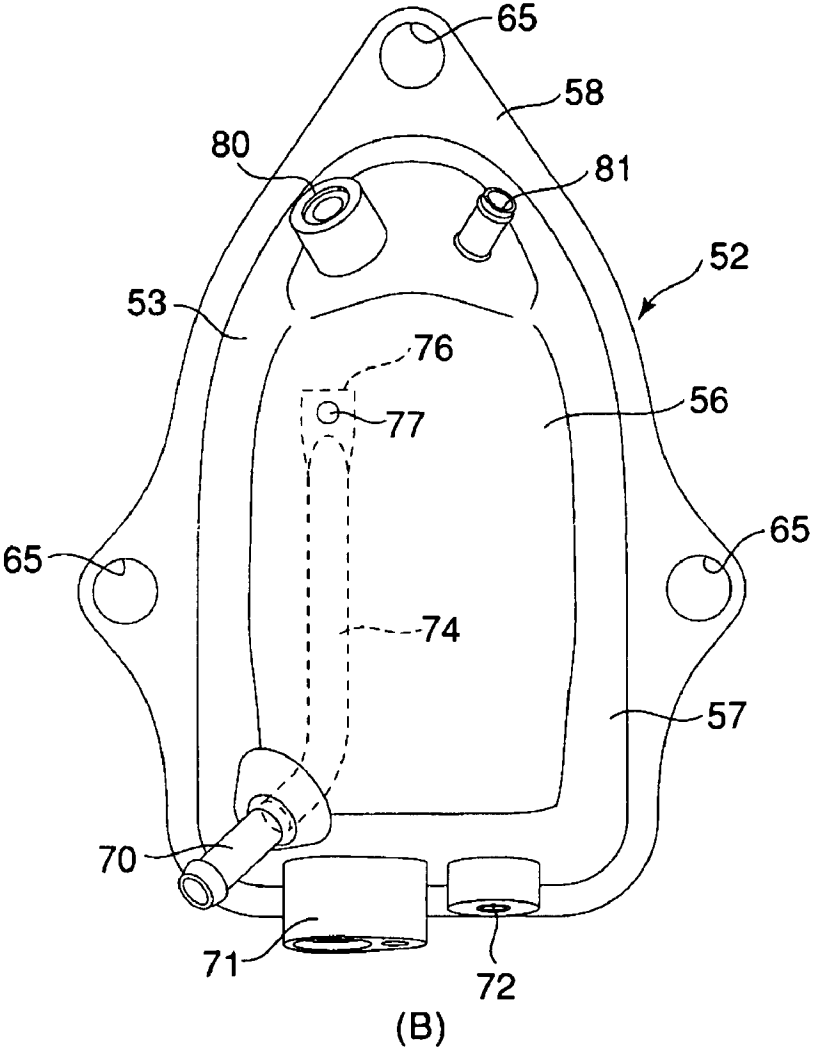
FIG. 6(A) is a side view of the oil tank showing a tank body partly in section in the embodiment of the present invention.
FIG. 6(B) is a rear view of the oil tank used in the embodiment of the present invention.
Figure 6:
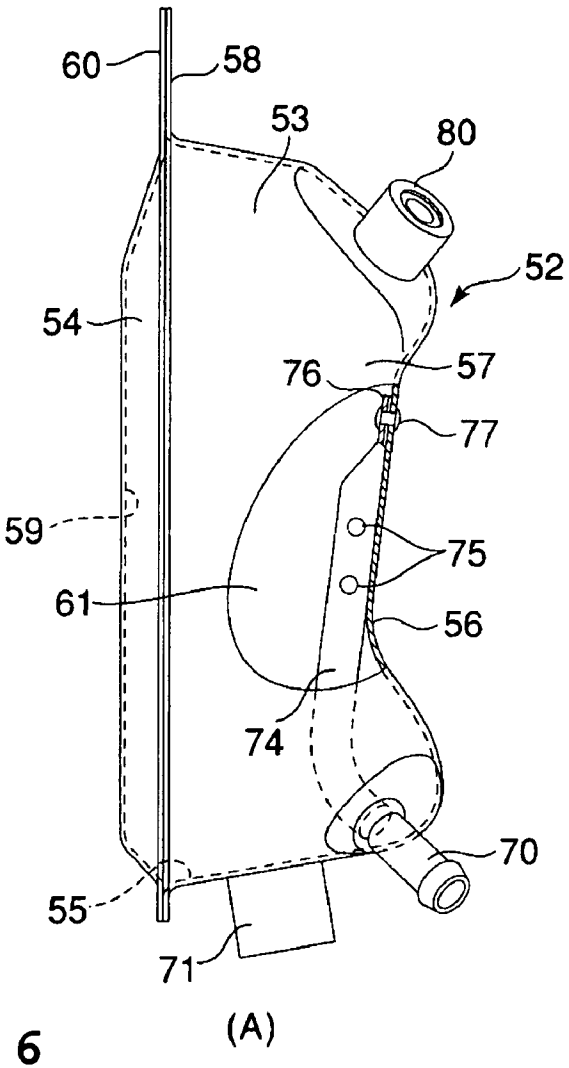

As shown in FIG. 1 through FIG. 3, the frame 2 is provided with a first frame section 20, a second frame section 21, left and right seat rails 22, and left and right seat pillar tubes 23.

The first frame section 20 is a cast product of an aluminum alloy and provided with a steering head pipe 24 and a gusset portion 25. The steering head pipe 24 is located at the forward end of the frame 2 and supports the front fork 3.

The gusset portion 25 extends rearwardly and obliquely downwardly from the steering head pipe 24. The gusset portion 25 is in a hollow, box-like shape elongated in the direction of the height of the frame 2. The gusset portion 25 has a connecting portion 26 protruding rearwardly and obliquely downwardly, and one first down tube 27 protruding downwardly.

The connecting portion 26 is in the shape of a square box expanded laterally of the vehicle toward the rear, and formed, at the rear end, with an opening 28 opening rearwardly. The first down tube 27 is in the shape of a rectangular tube of a square cross-section and has, at its lower ends, a pair of forked connecting arm portions 29*a*, 29*b*. The connecting arm portions 29*a*, 29*b* protrude downwardly along the first down tube 27 and disposed parallel, with a space left in the lateral direction of the vehicle.

The second frame section 21 is provided with a pair of rear arm brackets 31*a*, 31*b*, a cross member 32, and a rear cushion bracket 33. The rear arm brackets 31*a*, 31*b* are formed from forged products of an aluminum alloy. The rear arm brackets 31*a*, 31*b* stand behind the first down tube 27 in the direction of the height of the frame 2 and are disposed in parallel, and separate from each other laterally of the vehicle. The rear arm brackets 31*a*, 31*b* have bosses 34, respectively. The forward ends of the rear arm 4 are placed between the bosses 34 and supported by the bosses 34 through a pivot shaft 35.

The upper edges of the rear arm brackets 31*a*, 31*b* extend toward the connecting portion 26 of the first frame section 20. The upper ends of the rear arm brackets 31*a*, 31*b* are fitted in an opening 28 of the connecting portion 26 and welded to the edge of the opening 28.

The cross member 32 is formed from an extruded material of an aluminum alloy, in the shape of a rectangular tube. The cross member 32 connects the rear arm brackets 31*a*, 31*b* at the lower ends. The cross member 32 is located below the rear arm 4, and a link mechanism 36 extends across the space between the rear end of the cross member 32 and the rear arm 4.

The rear cushion bracket 33 is a cast product of an aluminum alloy and in the shape of a rectangular tube. The rear cushion bracket 33 connects the upper parts of the rear arm brackets 31*a*, 31*b*. The rear cushion bracket 33 is located directly above the rear arm 4 at the forward end. One hydraulic shock absorber 37 extends between the rear cushion bracket 33 and the link mechanism 36 connected to the rear arm 4.

As shown in FIG. 1, the rear cushion bracket 33 supports the forward end of the seat rail 22. The seat rail 22 extends rearwardly from the rear cushion bracket 33 and supports the rear half of the seat 7. The seat pillar tube 23 extends between the rear half of the seat rail 22 and the lower parts of the rear arm brackets 31*a*, 31*b* and supports the rear end of the seat rail 22.

As shown in FIG. 2, the connecting arm portions 29*a*, 29*b* of the first down tube 27 and the lower ends of the rear arm brackets 31*a*, 31*b* are connected through left and right second down tubes 40*a*, 40*b*. The second down tubes 40*a*, 40*b* are formed from extruded materials, for example, of an aluminum alloy. The second down tubes 40*a*, 40*b* have each a front half portion 41 and a rear half portion 42. The front half portions 41 are welded to the connecting arm portions 29*a*, 29*b*, respectively, and extend downwardly from the connecting arm portions 29*a*, 29*b*. The rear half portions 42 extend rearwardly from the lower ends of the front half portions 41 and are welded to the lower ends of the rear arm brackets 31*a*, 31*b*, respectively. Therefore, the second down tubes 40*a*, 40*b* are disposed separate from each other in the lateral direction of the vehicle.

The first down tube 27, second down tubes 40*a*, 40*b* and rear arm brackets 31*a*, 31*b* support the crankcase 11 of the engine 5 in a holding relation.

Specifically, as shown in FIG. 3, first engine brackets 43 are attached to the connecting arm portions 29*a*, 29*b* of the first down tube 27, respectively. The first engine brackets 43 extend rearwardly from the connecting arm portions 29*a*, 29*b* and support the forward end of the crankcase 11. Second engine brackets 44 are attached to the rear half portions 42 of the second down tubes 40*a*, 40*b*. The second engine brackets 44 extend upwardly from the rear half portions 42 and support the lower end of the crankcase 11. The lower end of the crankcase 11 is placed between the bosses 34 of the rear arm brackets 31*a*, 31*b* and is supported by the bosses 34 through a pivot shaft 35.

Therefore, the first and second down tubes 27 and 40*a*, 40*b*, respectively, run around the crankcase 11 from the front thereof toward a region therebelow.

Figure 7:
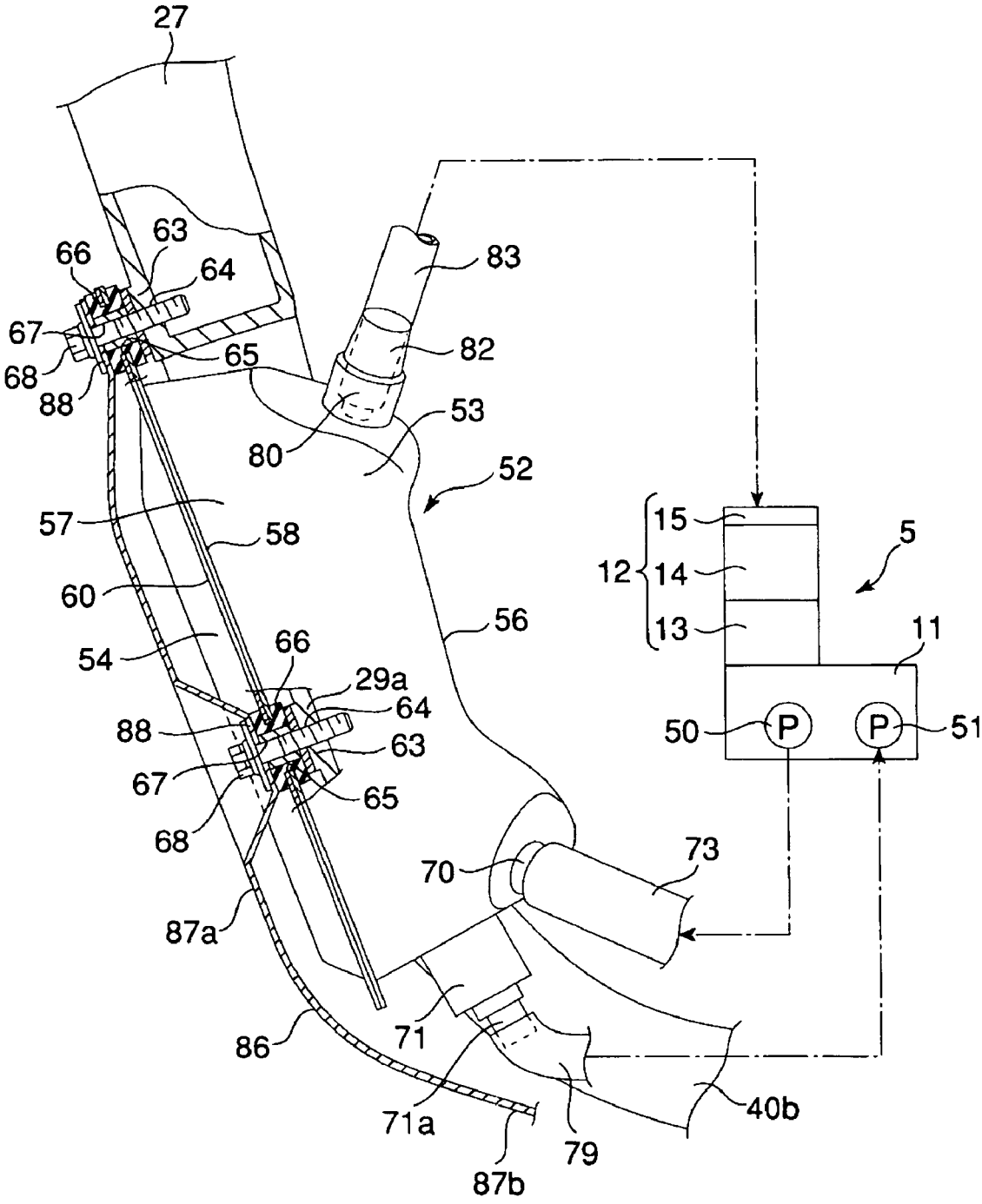
FIG. 7 is a sectional view showing the mounting structure of the oil tank and a protector to the frame in the embodiment of the present invention.
Figure 8:
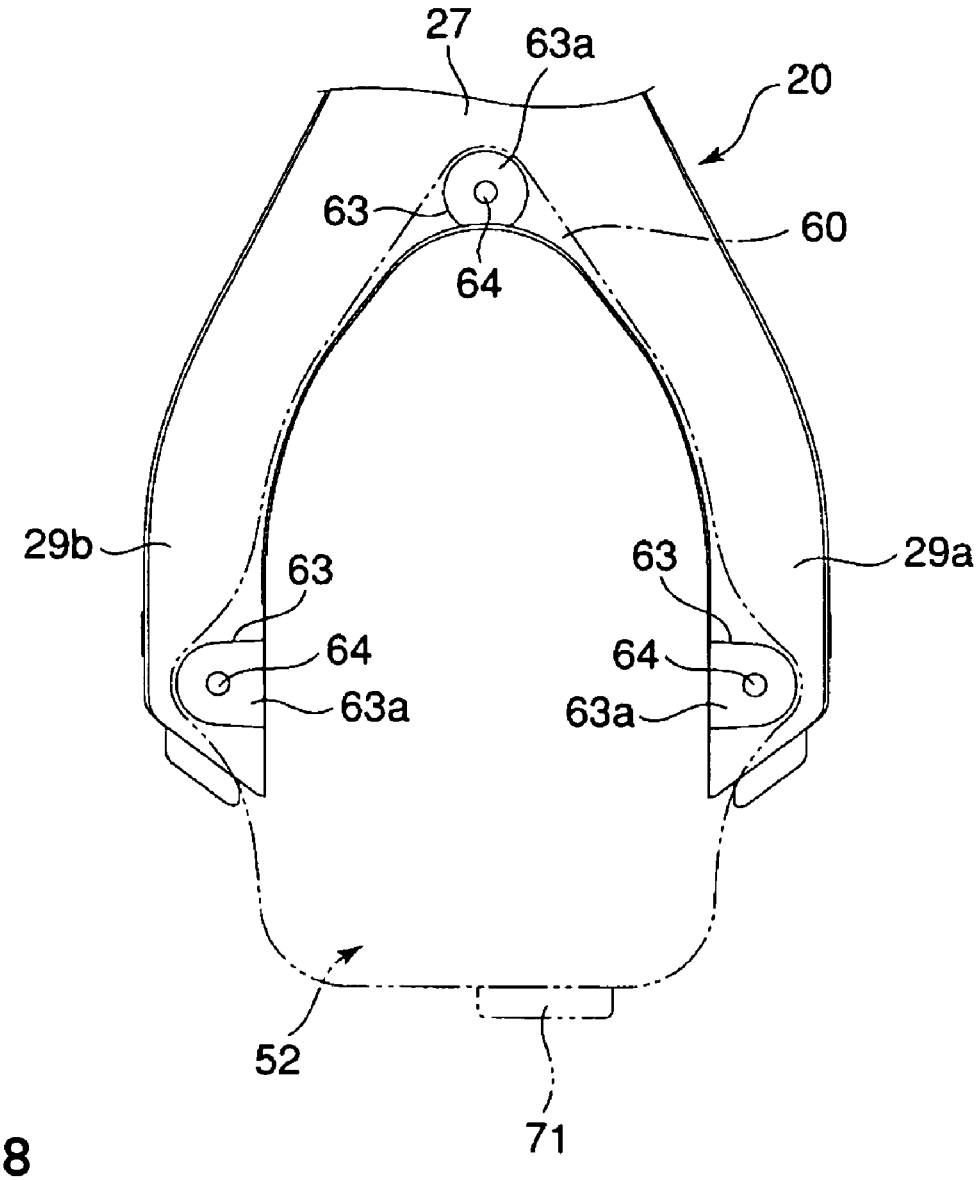
FIG. 8 is a front view showing the positional relationship between a first down tube and the oil tank in the embodiment of the present invention.

By the way, in the four-stroke engine 5 according to this embodiment, a dry sump type lubrication system is adopted in which no effective oil reservoir is provided in the bottom of the crankcase 11. As shown in FIG. 7, the dry sump type four-stroke engine 5 is provided with a first oil pump (scavenge pump) 50 for collecting lubricating oil returned to the crankcase 11 after lubrication of parts of the engine 5, a second oil pump 51 for supplying lubricating oil to the parts of the engine 5, and an oil tank 52 for storing lubricating oil. The first and second oil pumps 50 and 51, respectively, are assembled in the bottom of the crankcase 11. The first oil pump 50 for collecting lubricating oil has a larger capacity than the second oil pump 51 for supplying lubricating oil.

The oil tank 52 is one constituent independent from the crankcase 11 and located directly below the first down tube 27 and immediately in front of the crankcase 11. Specifically, the oil tank 52 is disposed in a region surrounded by the connecting arm portions 29*a*, 29*b* of the first down tube 27, the front half portions 41 of the second down tubes 40*a*, 40*b* and the forward end of the crankcase 11. Therefore, the oil tank 52 is formed compact enough to be received in the space between connecting portions of the first down tube 27 and the second down tubes 40*a*, 40*b*, and has a volume capable of storing lubricating oil, for example, of 700 cc.

As shown in FIG. 4 through FIG. 7, the oil tank 52 is provided with a tank body 53 and a front panel 54. The tank body 53 and the front panel 54 are formed from sheet metal stamping parts, respectively.

The tank body 53 is in a box-like shape having an opening end 55 opening toward the front of the crankcase 11, and placed between the connecting arm portions 29*a*, 29*b* of the first down tube 27 and the front half portions 41 of the second down tubes 40*a*, 40*b*. The tank body 53 has an end wall 56 facing the opening end 55 and a peripheral wall 57 rising up from the peripheral edge of the end wall 56. The end wall 56 is formed, by pressing, in a shape following the front end of the crankcase 11. The peripheral wall 57 has an edge portion surrounding the opening end 55, and this edge portion is formed with a first flange 58 bent outwardly approximately at a right angle.

The front panel 54 has a recess 59 facing the opening end 55, and a second flange 60 extending outwardly from the peripheral edge of the recess 59. The second flange 60 is brazed to the first flange 58 in an overlapping relation. As a result, the opening end 55 of the tank body 53 is closed liquid-tight by the front panel 54. A storage chamber 61 for storing lubricating oil is formed between the tank body 53 and the front panel 54.

As shown in FIG. 4 through FIG. 8, the first and second flanges 58 and 60, respectively, extend above the front face of the first down tube 27 at the lower end and the front faces of the connecting arm portions 29*a*, 29*b* are supported by the first down tube 27 at three locations.

Referring further to this support structure, the first down tube 27 has three bosses 63 on its front face. The bosses 63 are located at a central portion of the first down tube 27 at the lower end, and the lower ends of the connecting arm portions 29*a*, 29*b*, respectively. These bosses 63 are formed integral with the first down tube 27 during casting of the first frame section 20. The bosses 63 have flat seat faces 63*a*slightly protruding in front of the first down tube 27, and screw holes 64 are each formed centrally of the seat face 63*a*.

The first and second flange 58 and 60, respectively, of the oil tank 52 have three fitting holes 65 at positions corresponding to the bosses 63. Rubber grommets 66 are fitted in the fitting holes 65. Each grommet 66 has an insertion hole 67 at the center. A fixing bolt 68 is inserted into the insertion hole 67 of each of the grommets 66 from the front of the first down tube 27. The fixing bolt 68 passes through the insertion hole 67 and is screwed into the screw hole 64 of the boss 63. By the screw-in, the first and second flanges 58 and 60, respectively of the oil tank 52 are elastically supported in the seat surface 63*a* of the boss 63 through the grommets 66.

The tank body 53 is formed, at the bottom, with a first connecting port 70, a second connecting port 71, and a drain port 72. The first connecting port 70 protrudes rearwardly and obliquely downwardly from the left end of the bottom of the tank body 53. The first connecting port 70 is connected to a delivery port of the first oil pump 50 through a return passage 73 formed of a pipe and hose in combination. The return passage 73 is guided rearwardly under the crankcase 11 at the forward end and led out to the left side of the crankcase 11.

To the first connecting port 70 is connected an induction pipe 74 running into the storage chamber 61 of the oil tank 52. The induction pipe 74 rises inside the storage chamber 61 and is formed, at the upper part, with a plurality of jet holes 75 opened to the storage chamber 61. In addition, the induction pipe 74 is formed, at the upper end, with a fixing portion 76 flatted by pressing. The fixing portion 76 is fixed to the end wall 56 of the tank body 53 through a rivet 77.

As shown in FIG. 7, to the second connecting port 71 is attached a connecting pipe 71*a*protruding rearwardly. The connecting pipe 71*a*is connected to a suction port of the second oil pump 51 through a feed passage 79 formed of a pipe and hose in combination. The feed passage 79 is guided rearwardly under the crankcase 11 at the forward end and led out to the right side of the crankcase 11.

The drain port 72 is located at the right end of the bottom of the tank body 53. The drain port 72 is used for discharging lubricating oil stored in the oil tank 52, and stopped by an unillustrated drain plug.

The tank body 53 is formed, at the upper end, with a boss 80 and a third connecting port 81. The boss 80 supports a detachable oil level gage 82. The third connecting port 81 protrudes upwardly from the upper end of the tank body 53. To the third connecting port 81 is connected an overflow passage 83 of a hose or a pipe. The overflow passage 83 extends upwardly, passing in front of the cylinder section 12 of the engine 5, and is connected, at the upper end, to a boss 84 formed on the head cover 15. Therefore, the overflow passage 83 connects the upper end of the storage chamber 61 of the oil tank 52 and the valve drive chamber of the engine 5.

As shown in FIG. 1 and FIG. 7, the oil tank 52 and the crankcase 11 of the four-stroke engine 5 are covered by a protector 86. The protector 86 is formed, for example, from a plate of an aluminum alloy, and has a width corresponding to the distance between the second down tubes 40*a*, 40*b*.

The protector 86 has a first part 87*a* and a second part 87*b*. The first part 87*a* stands along the first down tube 27 such that it covers the oil tank 52 from the front. The second part 87*b* extends rearwardly from the lower end of the first part 87*a* and covers the crankcase 11, second down tubes 40*a*, 40*b*, return passage 73, and feed passage 79 from below.

The first part 87*a* of the protector 86 has three seats 88 at positions corresponding to the grommets 66 of the oil tank 52. The seats 88 overlap front faces of the grommets 66 and are fixed to the bosses 63 of the first down tube 27 through fixing bolts 68. Therefore, the first part 87*a* of the protector 86 and the oil tank 52 are fixed to the first down tube 27 through common fixing bolts 68. The second part 87*b* of the protector 86 is fixed, at a plurality of locations, to the under surfaces of the rear half portions 42 of the second down tubes 40*a*, 40*b* with unillustrated fixing bolts.

In the motorcycle 1 as described above, lubricating oil returns to the bottom of the crankcase 11 after lubricating the parts of the four-stroke engine 5. This lubricating oil is collected by the first oil pump 50 and delivered from the delivery port of the first oil pump 50 to the first connecting port 70 of the oil tank 52 through the return passage 73. Since the induction pipe 74 connected to the first connecting port 70 has jet holes 75 opened to the storage chamber 61 of the oil tank 52, lubricating oil sent from the first oil pump 50 is sprayed out into the storage chamber 61 through the jet holes 75.

As a result, lubricating oil returned to the crankcase 11 is sent into the oil tank 52 and stored temporarily in the storage chamber 61 of this oil tank 52.

Lubricating oil returned to the storage chamber 61 is drawn into the suction port of the second oil pump 51 from the second connecting port 71 through the feed passage 79. This lubricating oil is delivered to parts of the engine 5 through the second oil pump 51 to lubricate the engine 5 again. Therefore, lubricating oil is forcedly circulated between the four-stroke engine 5 and the oil tank 52.

By the way, the first oil pump 50 for delivering lubricating oil returned to the crankcase 11 to the oil tank 52 has a larger capacity than the second oil pump 51 for supplying lubricating oil to parts of the engine 5. Therefore, in a condition in which the engine speed is low during an idling operation, for example, lubricating oil returning to the oil tank 52 and lubricating oil drawn from the oil tank 52 are ill-balanced, and it may be possible that the amount of lubricating oil returning to the oil tank 52 becomes larger than the amount of lubricating oil drawn from the oil tank 52. If this really happens, because of the size reduction of the oil tank 52, the storage chamber 61 of a small volume is filled completely with lubricating oil.

However, in the foregoing arrangement, the upper end of the storage chamber 61 is connected to the valve drive chamber of the four-stroke engine 5 through the overflow passage 83. Therefore, if excess lubricating oil is returned to the storage chamber 61, the lubricating oil flows into the overflow passage 83 and automatically into the valve drive chamber through this overflow passage 83. As a result, even if the storage chamber 61 is decreased in its volume, a pressure rise of the storage chamber 61 in association with excessive inflow of the lubricating oil can be avoided. Therefore, damage of the oil tank 52 can be prevented, as well as leakage of lubricating oil from the connecting portion between the first connecting port 70 of the tank body 53 and the return passage 73, and the connecting portion between the second connecting portion 71 of the tank body 53 and the feed passage 79.

In addition, since an excess of the lubricating oil in the oil tank 52 is sent into the valve drive chamber of the cylinder head 14, the flow path of lubricating oil from the valve drive chamber to the crankcase 11 can be utilized as part of the overflow passage 83. In other words, since it takes time for the lubricating oil returned from the oil tank 52 to the valve drive chamber to reach the crankcase 11, a rise in the liquid level of the lubricating oil collected in the bottom of the crankcase 11 can be prevented. As a result, there is no possibility of crank webs of the crankshaft being immersed in the lubricating oil, avoiding the problem of a stirring loss of the crankshaft.

Further, in this arrangement, the oil tank 52 is configured such that the first flange 58 of the tank body 53 is overlapped by the second flange 60 of the front panel 54 from the front for brazing. The first and second flanges 58 and 60, respectively, of the oil tank 52 are fixed to the three bosses 63 of the first down tube 27 with fixing bolts 68. Therefore, when the fixing bolts are tightened, a force is applied to the joint portion of the first flange 58 and second flange 60 in the direction to press these flanges against each other, which strengthens connection of the tank body 53 and the front panel 54 further.

On the contrary, if the oil tank is, for example, configured such that its left and right halves are joined together, especially when the left and right halves are fastened to the frame, an unreasonable force might be applied to the joint portion of the left and right halves. Therefore, a problem arises that the joint portion of the left and right halves may warp, causing leakage of the lubricating oil.

However, in the foregoing embodiment, even if dispersion in fastening forces of the fixing bolts 68 is produced, no force is applied to warp the joint portion between the tank body 53 and the front panel 54. Therefore, leakage of lubricating oil from the oil tank 52 can be prevented.

Further, the first and second flanges 58 and 60, respectively, of the oil tank 52 do not extend toward the crankcase 11. Therefore, the end wall 56 of the tank body 53 can be brought as close to the forward end of the crankcase 11 as possible, suppressing forward extension of the oil tank 52.

Furthermore, the bosses 63 supporting the oil tank 52 are formed integral with the first down tube 27 during casting of the first frame section 20. This allows elimination of special brackets and the like for supporting the oil tank 52, reducing the number of parts of the frame 2. Further, since the brackets and the like are not required to be welded to the first down tuber 27, assembling man-hours can be reduced and a drop in strength of the first down tube 27 due to heat during welding can be avoided.

This invention is not limited to the foregoing embodiment, but can be practiced in various ways without departing from the spirit and scope thereof.

For example, in the foregoing embodiment, one down tube extending downwardly from the steering head pipe is branched in the middle to form a fork, and an oil tank is disposed under the fork. However, this invention is not limited to that, but the oil tank may be disposed between two down tubes extending downwardly from the steering head pipe.

Further, although in the foregoing embodiment, the overflow passage is connected to the valve drive chamber of the four-stroke engine, this invention is not limited to that, but the overflow passage may be connected, for example, to a cam chain passage, or to the crankcase as the case may be.

The invention claimed is:

1. A dry sump type lubrication device for a motorcycle, comprising:

a four stroke engine having, in a crankcase bottom, a first oil pump for collecting lubricating oil and a second oil pump for delivering lubricating oil;

a frame supporting the four-stroke engine and having left and right down tubes running around the crankcase from the crankcase front thereof toward a region therebelow;

an oil tank disposed in a region surrounded by a forward end of the crankcase and the left and right down tubes;

a return passage for the lubricating oil collected by the first oil pump to be returned to the oil tank;

a feed passage for the lubricating oil returned to the oil tank to be introduced into the second oil pump; and an overflow passage for the lubricating oil in the oil tank to be returned to the four-stroke engine.

2. The dry sump type lubrication device for a motorcycle of claim 1, wherein the overflow passage connects an upper end of the oil tank with a cylinder head of the four-stroke engine.

3. The dry sump type lubrication device for a motorcycle of claim 1, wherein the oil tank is provided with a tank body located between the down tubes and a front panel covering a front portion of the tank body and forming a storage chamber for storing lubricating oil between the tank body and the front panel, the tank body has a first connecting port connected with the return passage, a second connecting port connected with the feed passage, and a third connecting port connected with the overflow passage.

4. A dry sump type lubrication device for a motorcycle, comprising:

a cradle type frame having one first down tube extending downwardly from a steering head pipe and having a pair of forked connecting arm portions at a lower end, and left and right second down tubes connected to the connecting arm portions of the first down tube;

a four-stroke engine having a crankcase supported by the first down tube and the second down tubes;

an oil tank disposed in a region surrounded by the connecting arm portions of the first down tube, the second down tubes, and a forward end of the crankcase for storing lubricating oil forcedly circulated between the crankcase and the oil tank; and an overflow passage connecting an upper part of the oil tank and the four-stroke engine for an excess of the lubricating oil in the oil tank to be returned to the four-stroke engine.

5. The dry sump type lubrication device for a motorcycle of claim 4, the first down tube is a cast product and formed integrally with a plurality of bosses for supporting the oil tank.

6. The dry sump type lubrication device for a motorcycle of claim 4, wherein a return passage for the lubricating oil returning from the crankcase to flow and a feed passage for the lubricating oil to flow toward the crankcase are connected to a bottom part of the oil tank.

7. The dry sump type lubrication device for a motorcycle of claim 6, wherein the oil tank is provided with a tank body having an opening end opening forwardly of the crankcase, and a front panel closing the opening end of the tank body and forming a storage chamber for storing lubricating oil between the tank body and the front panel, the tank body has a first connecting port connected with the return passage, a second connecting port connected with the feed passage, and a third connecting port connected with the overflow passage.

8. A motorcycle, comprising:

a four-stroke engine having a crankcase;

a frame supporting the four-stroke engine; and a dry sump type lubrication device for the motorcycle, wherein the frame has left and right down tubes supporting a forward end of the crankcase, an oil tank for storing lubricating oil forcedly circulated between the crankcase and the oil tank disposed in a region surrounded by the down tubes and the forward end of the crankcase, and an upper part of the oil tank and the four-stroke engine are connected through an overflow passage.

9. The dry sump type lubrication device for a motorcycle of claim 8, wherein the overflow passage is connected to the cylinder head of the four-stroke engine.

10. The dry sump type lubrication device for a motorcycle of claim 2, wherein the oil tank is provided with a tank body located between the down tubes and a front panel covering a front portion of the tank body and forming a storage chamber for storing lubricating oil between the tank body and the front panel, the tank body has a first connecting port connected with the return passage, a second connecting port connected with the feed passage, and a third connecting port connected with the overflow passage.

11. The dry sump type lubrication device for a motorcycle of claim 8, wherein the oil tank is provided with a tank body located between the down tubes and a front panel covering a front portion of the tank body and forming a storage chamber for storing lubricating oil between the tank body and the front panel, the tank body has a first connecting port connected with the return passage, a second connecting port connected with the feed passage, and a third connecting port connected with the overflow passage.

12. The dry sump type lubrication device for a motorcycle of claim 1, further comprising a cylinder block connected to an upper surface of the crankcase.

13. The dry sump type lubrication device for a motorcycle of claim 4, further comprising a cylinder block connected to an upper surface of the crankcase.

14. The dry sump type lubrication device for a motorcycle of claim 8, further comprising a cylinder block connected to an upper surface of the crankcase.

15. The dry sump type lubrication device for a motorcycle of claim 1, further comprising a drive sprocket at a rear end of the crankcase.

16. The dry sump type lubrication device for a motorcycle of claim 4, further comprising a drive sprocket at a rear end of the crankcase.

17. The dry sump type lubrication device for a motorcycle of claim 8, further comprising a drive sprocket at a rear end of the crankcase.

18. The dry sump type lubrication device for a motorcycle of claim 3, wherein the front panel and tank body are formed from sheet metal stamping parts.

19. The dry sump type lubrication device for a motorcycle of claim 7, wherein the front panel and tank body are formed from sheet metal stamping parts.

20. The dry sump type lubrication device for a motorcycle of claim 11, wherein the front panel and tank body are formed from sheet metal stamping parts.

* * * * *